US008680399B2

(12) United States Patent
Eaton

(10) Patent No.: US 8,680,399 B2
(45) Date of Patent: Mar. 25, 2014

(54) CABLE INSULATION WITH REDUCED ELECTRICAL TREEING

(75) Inventor: Robert F. Eaton, Belle Mead, NJ (US)

(73) Assignee: Union Carbide Chemicals & Plastics Technology LLC, Midland, MI (US)

( * ) Notice: Subject to any disclaimer, the term of this patent is extended or adjusted under 35 U.S.C. 154(b) by 445 days.

(21) Appl. No.: 12/531,083

(22) PCT Filed: Mar. 14, 2008

(86) PCT No.: PCT/US2008/056973

§ 371 (c)(1),
(2), (4) Date: Sep. 14, 2009

(87) PCT Pub. No.: WO2008/112965

PCT Pub. Date: Sep. 18, 2008

(65) Prior Publication Data

US 2010/0101823 A1 Apr. 29, 2010

Related U.S. Application Data

(60) Provisional application No. 60/894,925, filed on Mar. 15, 2007.

(51) Int. Cl.
*H01B 7/00* (2006.01)

(52) U.S. Cl.
USPC ..... 174/110 R; 174/110 AR; 174/110 SR

(58) Field of Classification Search
USPC .... 174/110 R, 113 R, 120 R, 120 SC, 102 R, 174/102 SC
See application file for complete search history.

(56) References Cited

U.S. PATENT DOCUMENTS

| | | | |
|---|---|---|---|
| 3,956,420 | A | 5/1976 | Kato et al. |
| 4,018,852 | A | 4/1977 | Schober |
| 4,144,202 | A | 3/1979 | Ashcraft et al. |
| 4,206,260 | A | 6/1980 | McMahon |
| 4,263,158 | A | 4/1981 | Ashcraft et al. |
| 4,857,600 | A | 8/1989 | Gross et al. |
| 5,064,802 | A | 11/1991 | Stevens et al. |
| 5,246,783 | A | 9/1993 | Spenadel et al. |
| 5,272,236 | A | 12/1993 | Lai et al. |
| 5,278,272 | A | 1/1994 | Lai et al. |
| 5,300,575 | A | 4/1994 | Jonas et al. |
| 5,346,961 | A | 9/1994 | Shaw et al. |
| 5,575,965 | A | 11/1996 | Caronia et al. |

(Continued)

FOREIGN PATENT DOCUMENTS

| | | | |
|---|---|---|---|
| CN | 1787123 | A | 6/2006 |
| EP | 1295910 | A1 | 3/2003 |

(Continued)

OTHER PUBLICATIONS

Tanaka et al., "Basic Concepts and Testing", Advanced Power Cable Technology, vol. 1, undated (pp. 102-104).

(Continued)

*Primary Examiner* — William H Mayo, III
(74) *Attorney, Agent, or Firm* — Whyte Hirschboeck Dudek S.C.

(57) ABSTRACT

Treeing is suppressed in cables through the use of an insulation layer that includes a polyolefin polymer and an additive with delocalized electron structure. The additive can be a carotenoid, carotenoid analog, a carotenoid derivative, a conducting polymer or a combination of two or more such materials.

17 Claims, 1 Drawing Sheet

(56) References Cited

U.S. PATENT DOCUMENTS

| | | | | |
|---|---|---|---|---|
| 5,798,170 | A | 8/1998 | Zhang et al. | |
| 5,929,137 | A | 7/1999 | Marsac et al. | |
| 5,986,028 | A | 11/1999 | Lai et al. | |
| 6,197,219 | B1 * | 3/2001 | Foulger | 252/500 |
| 6,274,066 | B1 * | 8/2001 | Easter | 252/511 |
| 6,496,629 | B2 | 12/2002 | Ma et al. | |
| 6,506,492 | B1 * | 1/2003 | Foulger | 428/372 |
| 6,540,654 | B2 * | 4/2003 | Levy et al. | 554/224 |
| 6,714,707 | B2 | 3/2004 | Rossi et al. | |
| 6,969,595 | B2 | 11/2005 | Brzostowicz et al. | |
| 7,153,571 | B2 * | 12/2006 | Allermann | 428/391 |
| 7,767,910 | B2 * | 8/2010 | Kjellqvist et al. | 174/110 R |
| 2002/0032258 | A1 * | 3/2002 | Tsukada et al. | 524/261 |
| 2005/0092971 | A1 * | 5/2005 | Easter | 252/500 |
| 2005/0148715 | A1 * | 7/2005 | Caronia et al. | 524/330 |
| 2005/0205290 | A1 * | 9/2005 | Pinacci et al. | 174/121 A |
| 2010/0032188 | A1 * | 2/2010 | Meier et al. | 174/140 C |

FOREIGN PATENT DOCUMENTS

| | | | |
|---|---|---|---|
| EP | 0962944 | B1 | 5/2005 |
| GB | 1278326 | | 6/1972 |
| GB | 1278326 | A | 6/1972 |
| JP | 52047042 | | 4/1977 |
| JP | 200125833 | | 9/2001 |
| WO | 93/19104 | A1 | 9/1993 |
| WO | 95/00526 | A1 | 1/1995 |
| WO | 95/14024 | A1 | 5/1995 |
| WO | 98/49212 | A1 | 11/1998 |
| WO | 02/073631 | A1 | 9/2002 |

OTHER PUBLICATIONS

ASTM International, "Engineering Dielectrics Volume IIA Electrical Properties of Solid Insulating Materials: Molecular Structure and Electrical Behavior", Electrical Properties, Part A, Chapter 4—Treeing in Solid Organic Dielectrics, undated, (pp. 390-399).

Gorman et al., "Soluble, Highly Conjugated Derivatives of Polyacetylene from the Ring-Opening Metathesis Polymerization of Monosubstituted Cyclooctatetraenes; Synthesis and the Relationship between Polymer Structure and Physical Properties", J. Am. Chem. Soc., vol. 115, 1993 (pp. 1397-1409).

Heeger, "Semiconducting and Metallic Polymers: The Fourth Generation of Polymeric Materials", J. Phys. Chem. B, vol. 105, No. 36, Sep. 13, 2001 (pp. 8475-8491).

Reynolds et al., "Electrically Conducting Polymers Containing Alternating Substituted Phenylene and Bithiophene Repeat Units", Macromolecules, vol. 24, 1991 (pp. 678-687).

Machine translation of CN1787123.

* cited by examiner

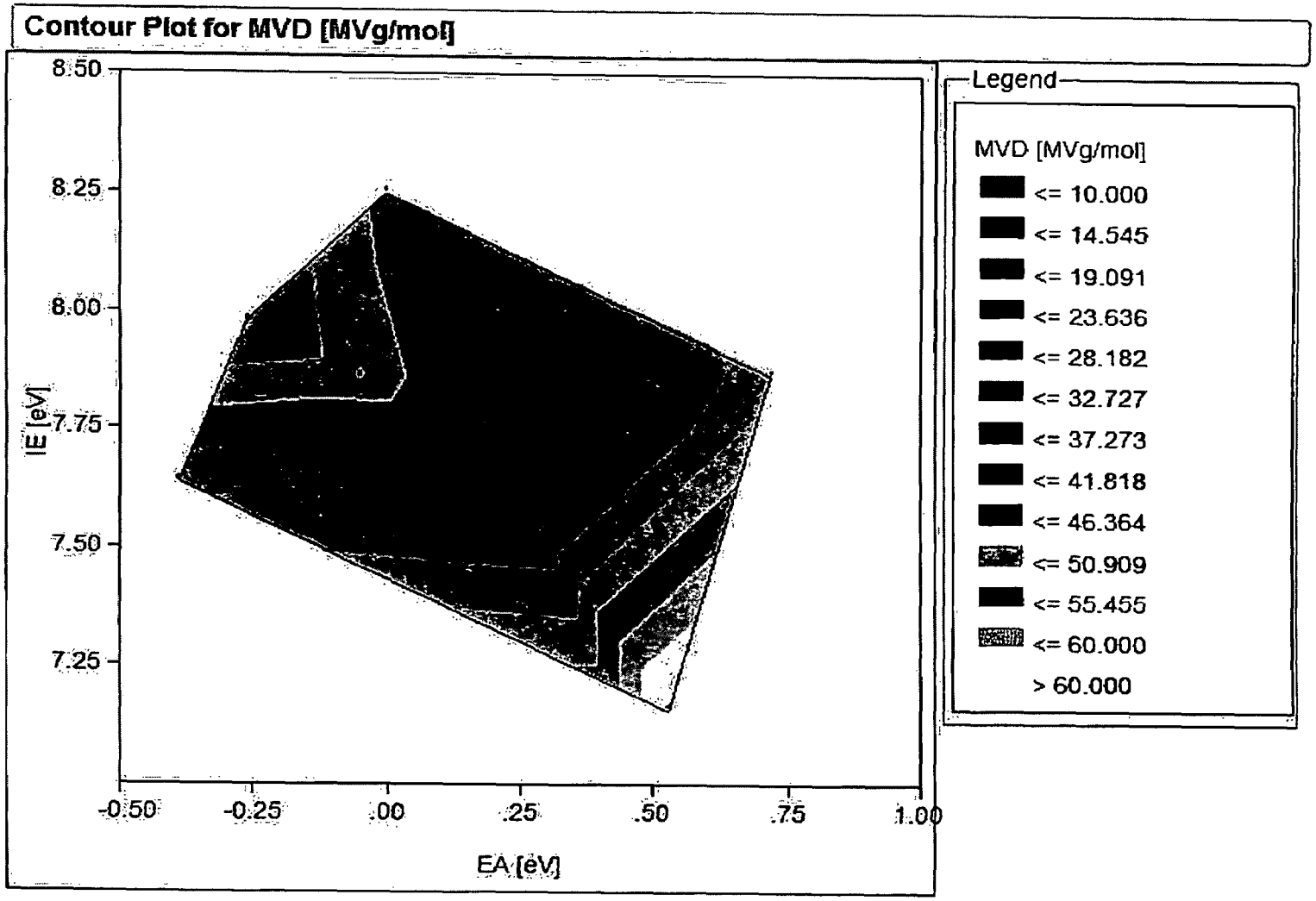
Contour Plot for MVD [MVg/mol]
Legend
MVD [MVg/mol]
<= 10.000
<= 14.545
<= 19.091
<= 23.636
<= 28.182
<= 32.727
<= 37.273
<= 41.818
<= 46.364
<= 50.909
<= 55.455
<= 60.000
> 60.000
8.50
8.25
8.00
7.75
7.50
7.25
IE [eV]
-0.50
-0.25
.00
.25
.50
.75
1.00
EA [eV]

CABLE INSULATION WITH REDUCED ELECTRICAL TREEING

CROSS-REFERENCE TO RELATED APPLICATIONS

This application is a 371 national stage entry of International Application No. PCT/US2008/056973, filed Mar. 14, 2008which claims the benefit of priority to U.S. Provisional Application No. 60/894,925, filed Mar. 15, 2007.

FIELD OF THE INVENTION

This invention relates to compositions comprising a polyolefin polymer and an oligomer or polymer with delocalized electron structure. In one aspect, the invention relates to cables and wires. In another aspect, the invention relates to power cables comprising an insulation layer and in still another aspect, the invention relates to a power cable in which the insulation layer comprises a composition comprising a polyolefin polymer and an oligomer or polymer with high molecular weight and delocalized electron structure.

BACKGROUND OF THE INVENTION

Polymeric compositions are used extensively as primary insulation materials for wire and cable. As an insulator, it is important that the composition have various physical and electrical properties, such as resistance to mechanical cut through; stress crack resistance; and dielectric failure. Unfortunately, the efficient use of polymeric compositions in high voltage cables has been hampered by a degradation process called "treeing."

Treeing is a relatively slow progressive degradation of an insulation caused by electron and ion bombardment of the insulation resulting in the formation of microchannels or tubes having a tree-like appearance, hence the name. A tree initiates at points of contamination or voids that are foreign to the polymeric insulation by the action of ionization (corona) during high voltage surges. Once a tree starts it usually grows, particularly during further high voltage surges, and at some undetermined time, dielectric failure can occur.

There are two types of treeing: (1) electrical treeing and (2) water treeing. Water or electrochemical trees form in the presence of water and in particular at low voltages. When water is absent, the trees that form are called electrical trees.

Electrical treeing results from internal electrical discharges that decompose the dielectric. High voltage impulses can produce electrical trees. The damage that results from the application of alternating current voltages to the electrode/insulation interfaces, which can contain imperfections, is commercially significant. In this case, very high, localized stress gradients can exist and with sufficient time can lead to initiation and growth of trees A common practice used to reduce the possibility of tree generation is to introduce additives into the polymeric compositions, which are often referred to as "voltage stabilizers." Additives function in a variety of ways: (1) to capture energetic electrons chemically; (2) to slow down discharge path growth electrically; (3) to make the surfaces of internal cavities conductive; (4) to increase the bulk conductance to grade the field; and (5) to interfere physically with tree propagation. Gases, oils, liquids, waxes antioxidants, catalyst stabilizers, and mineral fillers of low hygroscopicity are all candidates for compounding agents for this purpose.

Voltage stabilizers, such as acetophenone, fluoranthene, pyrene, naphthalene, o-terphenyl, vinylnaphthalene, chrysene, anthracene, alkylfluoranthenes and alkylpyrenes, are thought to trap and deactivate electrons, and thus inhibit treeing. However, the volatility, migration, low solubility, and toxicity of the voltage stabilizers have limited their commercial success. When the volatility of the compound is too great, the compound will migrate to the surface, and evaporate, thereby eliminating the effectiveness of the compound. In addition, the compounds are toxic, and thus migration of the compounds to undesired locations, is problematic.

Silicones have found limited use in the area of anti-treeing. U.S. Pat. No. 3,956,420 discloses the use of a combination of ferrocene, in 8-substituted quinoline, and a silicone liquid to increase the dielectric strength of polyethylene and its voltage endurance in water. U.S. Pat. No. 4,144,202 inhibits water treeing in ethylene polymer compositions by employing organosilanes containing an epoxy radical. U.S. Pat. No. 4,263,158 further discloses the use of organosilanes containing carbon-nitrogen double bonds to inhibit water treeing in ethylene polymers.

Water tree growth and electrical tree growth in primary insulation still remains an important problem as treeing is still associated with dielectric failure. Thus, a need still exists for voltage stabilizers with low toxicity, low volatility and good compatibility with polyolefins, which can inhibit or retard treeing.

SUMMARY OF THE INVENTION

In one embodiment, the invention is a power cable comprising an insulation layer in which the insulation layer comprises a polyolefin polymer and a voltage stabilizer with delocalized electronic structure. In another embodiment, the invention is a composition comprising a polyolefin polymer and a voltage stabilizer with delocalized electron structure.

In yet another embodiment, the invention is a method to reduce electrical treeing in cables. In still another embodiment, the voltage stabilizers of the present invention are conducting oligomers or polymers of high molecular weigh and delocalized electron structure. In another embodiment, the voltage stabilizers of the present invention have low toxicity, low volatility, and miscibility with polyolefins and related polymers. In yet another embodiment, the present invention relates to carotenoids, carotenoid analogs, carotenoid derivatives, conducting polymers, carbon black and combinations thereof. In still another embodiment, the invention relates to a power cable comprising a voltage stabilizer with an electron affinity of at least 0.0 eV, preferably a voltage stabilizer with an electron affinity of at least 5 eV, and more preferably a voltage stabilizer with an electron affinity of at least 10 eV. In yet another embodiment, the invention relates to a power cable comprising a voltage stabilizer with an ionization energy that does not exceed 8 eV, preferably the ionization energy does not exceed 5 eV, and more preferably the ionization energy does not exceed 3 eV. In still yet another embodiment, the invention relates to a power cable comprising a voltage stabilizer with an electron affinity of at least 0.0 eV, and an ionization energy that does not exceed 8 eV.

BRIEF DESCRIPTION OF THE DRAWINGS

FIG. 1 is a contour plot demonstrating the dependence of Molar Voltage Difference on adiabatic electron affinity (EA labeled axis) and ionization energy (IE labeled axis).

DESCRIPTION OF THE PREFERRED EMBODIMENT

The numerical ranges in this disclosure are approximate, and thus may include values outside of the range unless otherwise indicated. Numerical ranges include all values from and including the lower and the upper values, in increments of one unit, provided that there is a separation of at least two units between any lower value and any higher value. As an example, if a compositional, physical or other property, such as, for example, molecular weight, viscosity, melt index, etc., is from 100 to 1,000, it is intended that all individual values, such as 100, 101, 102, etc., and sub ranges, such as 100 to 144, 155 to 170, 197 to 200, etc., are expressly enumerated. For ranges containing values which are less than one or containing fractional numbers greater than one (e.g., 1.1, 1.5, etc.), one unit is considered to be 0.0001, 0.001, 0.01 or 0.1, as appropriate. For ranges containing single digit numbers less than ten (e.g., 1 to 5), one unit is typically considered to be 0.1. These are only examples of what is specifically intended, and all possible combinations of numerical values between the lowest value and the highest value enumerated, are to be considered to be expressly stated in this disclosure. Numerical ranges are provided within this disclosure for, among other things, the amount of voltage stabilizer relative to the composition, and the amount of carotenoid, carotenoid analog, carotenoid derivative, carbon black or conducting polymer relative to the composition.

"Cable," "power cable," and like terms means at least one wire or optical fiber within a protective jacket or sheath. Typically, a cable is two or more wires or optical fibers bound together, typically in a common protective jacket or sheath. The individual wires or fibers inside the jacket may be bare, covered or insulated. Combination cables may contain both electrical wires and optical fibers. The cable, etc. can be designed for low, medium and high voltage applications. Typical cable designs are illustrated in U.S. Pat. Nos. 5,246,783, 6,496,629 and 6,714,707.

"Polymer" means a polymeric compound prepared by polymerizing monomers, whether of the same or a different type. The generic term polymer thus embraces the term homopolymer, usually employed to refer to polymers prepared from only one type of monomer, and the term interpolymer as defined below.

"Interpolymer" means a polymer prepared by the polymerization of at least two different types of monomers. This generic term includes copolymers, usually employed to refer to polymers prepared from two different types of monomers, and polymers prepared from more than two different types of monomers, e.g., terpolymers, tetrapolymers, etc.

"Polyolefin", "PO" and like terms mean a polymer derived from simple olefins. Many polyolefins are thermoplastic and for purposes of this invention, can include a rubber phase. Representative polyolefins include polyethylene, polypropylene, polybutene, polyisoprene and their various interpolymers.

"Blend," "polymer blend" and like terms mean a composition of two or more polymers. Such a blend may or may not be miscible. Such a blend may or may not be phase separated. Such a blend may or may not contain one or more domain configurations, as determined from transmission electron spectroscopy, light scattering, x-ray scattering, and any other method known in the art.

"Carotenoids" means the more than 700 naturally occurring carotenoids described in the literature, and their stereo- and geometric isomers. Carotenoids without oxygenated functional groups are called "carotenes," reflecting their hydrocarbon nature; oxygenated carotenes are known as "xanthophylls."

"Carotenoid analog" and "carotenoid derivative," means chemical compounds or compositions derived from a naturally occurring or synthetic carotenoid. Terms such as carotenoid analog and carotenoid derivative may also generally refer to chemical compounds or compositions that are synthetically derived from non-carotenoid based parent compounds but that substantially resemble a carotenoid derived analog. "Derivative" means a chemical substance derived from another substance either directly or by modification or partial substitution. "Analog" means a compound that resembles another in structure but is not necessarily an isomer. Typical analogs or derivatives include molecules that demonstrate equivalent or improved resistance to treeing, but that differ structurally from the parent compounds. Such analogs or derivatives may include, but are not limited to, esters, ethers, carbonates, amides, carbamates, phosphate esters and ethers, sulfates, glycoside ethers, with or without spacers (linkers).

"Ionization potential" and "ionization energy" ($E_I$) of an atom or molecule means the energy required to remove one mole of electrons from one mole of isolated gaseous atoms or ions. Ionization potential is a measure of the "reluctance" of an atom or ion to surrender an electron, or the "strength" by which the electron is bound; the greater the ionization energy, the more difficult it is to remove an electron. The ionization potential is an indicator of the reactivity of an element. Elements with low ionization energy tend to be reducing agents and to form salts.

"Electron affinity" means the energy given off when a neutral atom in the gas phase gains an extra electron to form a negatively charged ion.

"Vertical electron affinity" means the energy difference between the energy of the optimized neutral molecule and the energy of the un-optimized radical anion.

"Adiabatic electron affinity" means the difference between the energy of the optimized neutral molecule and the energy of the optimized radical anion.

In one embodiment, the present invention relates to compositions comprising a polyolefin polymer and a voltage stabilizer with delocalized electron structure, which function as an anti-treeing agent. Voltage stabilizers with low toxicity, low volatility and good compatibility with polyolefins can be used in the present invention. Oligomers and polymers of high molecular weight and delocalized electron structures can be used as voltage stabilizers in the present invention and include but are not limited to carotenoids, carotenoid analogs, carotenoid derivatives, conducting polymers, carbon black and combinations thereof.

Oligomers and polymers of high molecular weight typically have a number average molecular weight ($M_n$) of at least 10,000, preferably at least 20,000, and more preferably at least 60,000. Typically, the $M_n$ of the oligomers and polymers does not exceed 250,000, preferably the $M_n$ does not exceed 100,000 and more preferably the $M_n$ does not exceed 80,000.

Carotenoids:

Carotenoids are a group of natural pigments produced principally by plants, yeast, and microalgae. The family of related compounds now numbers greater than 700 described members, exclusive of Z and E isomers. All carotenoids share common chemical features, such as a polyisoprenoid structure, a long polyene chain forming the chromophore, and near symmetry around the central double bond. Tail-to-tail linkage of two $C_{20}$ geranylgeranyl diphosphate molecules produces the parent $C_o$ carbon skeleton.

Carotenoids with chiral centers may exist either as the R (rectus) or S (sinister) configurations. As an example, astaxanthin (with 2 chiral centers at the 3 and 3' carbons) may exist as 4 possible stereoisomers: 3S, 3'S; 3R, 3'S and 3S, 3'R (meso forms); or 3R, 3'R. The relative proportions of each of the stereoisomers may vary by natural source.

Any carotenoid, carotenoid analog, or carotenoid derivative is useful in the present invention including but not limited to antheraxanthin, actinioerythrin adonixanthin, alloxanthin, astacein, astaxanthin, bixin, canthaxanthin, capsorubrin, beta.-cryptoxanthin, alpha-carotene, beta-carotene, epsilon-carotene, echinenone, gamma-carotene, zeta-carotene, canthaxanthin, capsanthin, capsorubin, chlorobactene, alpha-cryptoxanthin, crocetin, crocetinsemialdehyde, crocin, crustaxanthin, cryptocapsin, cynthiaxanthin, decaprenoxanthin, diatoxanthin, 7,8-didehydroastaxanthin, diadinoxanthin, eschscholtzxanthin, eschscholtzxanthone, flexixanthin, fucoxanthin, fucoxanthinol, gazaniaxanthin, hopkinsiaxanthin, hydroxyspheriodenone, isofucoxanthin, isorenieratene, lactucaxanthin, loroxanthin, lutein, luteoxanthin, lycopene, lycopersene, lycoxanthin, neoxanthin, neochrome, neurosporene, hydroxyneurosporene, nonaprenoxanthin, okenone, oscillaxanthin, paracentrone, pectenolone, pecteneoxanthin, peridinin, phleixanthophyll, phoeniconone dehydroadonirubin, phoenicopterone, phytoene, phtofluene hexahydrolycopene, pyrrhoxanthininol, rhodopin, rhodopin glucoside, rhodopinol warmingol, rhodoxanthin, rhodovibrin, rubixanthone, saproxanthin, semi-α-carotene, semi-β-carotene, sintaxanthin, siphonein, siphonaxanthin, spheroidene, spheroidenone, spirilloxanthin, tangeraxanthin, torulene, torularhodinaldehyde, torularhodin, torularhodin methyl ester, uriolide, uriolide acetate, vaucheriaxanthin, violaxanthin, xanthophyll, zeaxanthin β-diglucoside, α-zeacarotene, and zeaxanthin. Additionally the invention encompasses derivitization of these molecules to create hydroxy-, methoxy-, oxo-, epoxy-, carboxy-, or aldehydic functional groups, or glycoside esters, or sulfates.

All carotenoids may be formally derived from the acyclic $C_{40}H_{56}$ precursor structure (Formula I below), having a long central chain of conjugated double bonds, by (i) hydrogenation, (ii) dehydrogenation, (iii) cyclization, or (iv) oxidation, or any combination of these processes.

Formula I

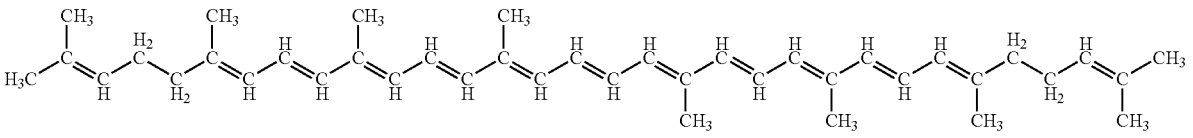

This class also includes certain compounds that arise from certain rearrangements of the carbon skeleton (I), or by the (formal) removal of part of this structure. Carotenoids, carotenoid analogs, and carotenoid derivatives can be produced by chemical synthesis.

There are two commonly used industrial methods for total synthesis of β-carotene (Formula II). The first was developed by the Badische Anilin- & Soda-Fabrik (BASF) and is based on the Wittig reaction. The second is a Grignard reaction, elaborated by Hoffman-La Roche from the original synthesis of Inhoffen et al. They are both symmetrical; the BASF synthesis is $C_{20}+C_{20}$, and the Hoffman-La Roche synthesis is $C_{19}+C_2+C_{19}$.

Formula II

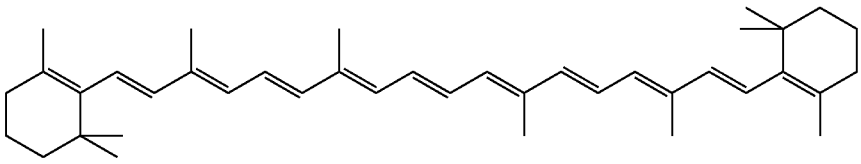

Carotenoids also can be produced using recombinant DNA technologies. U.S. Pat. No. 6,969,595 discloses methods for the creation of recombinant organisms that have the ability to produce various carotenoid compounds. Genes involved in the biosynthesis of carotenoid compounds can be expressed in microorganisms that are able to use single carbon substrates as a sole energy source. Such microorganisms are referred to as C1 metabolizers. C1 metabolizers include but are not limited to methylotrophs and/or methanotrophs. The host microorganism may be any C1 metabolizer including those that have the ability to synthesize isopentenyl pyrophosphate (IPP) the precursor for many of the carotenoids.

Certain carotenoids can be obtained from commercial sources. For instance, astaxanthin, beta-carotene, lycopene, and xanthophyll are available from Sigma Aldrich (St. Louis, Mo.). Synthetic astaxanthin, produced by large manufacturers such as Hoffmann-LaRochek AG, Buckton Scott (USA), or BASF AG, are provided as defined geometric isomer mixtures of a 1:2:1 stereoisomer mixture [3S, 3'S; 3R, 3'S, 3'R, 3S (meso); 3R, 3'R] of non-esterified, free astaxanthin.

Anthocyanins, which are oligomers with delocalized electron structure, can also be used in the present invention. Examples of anthocyanins include but are not limited to aurantinidin, cyaniding, delphinidin, europinidin, luteolindin, pelargonidin, malvidin, peonidin, petunidin, and rosinidin.

Conducting Polymers:

Conducting polymers also can be used in the present invention as anti-treeing agents. Conducting polymers are conjugated polymers, namely organic compounds that have an extended p-orbital system, through which electrons can move from one end of the polymer to the other. Conducting polymers undergo either p- and/or n-redox doping by chemical and/or electrochemical processes. The conducting polymer has π-conjugated electrons spread along its backbone and contains delocalized electron structure after doping. P-doping involves partial oxidation of the π-system, whereas n-doping involves partial reduction of the π system. Polyaniline undergoes doping by a large number of protonic acids. The conductivity of these materials can be tuned by chemical manipulation of the polymer backbone, by the nature of the dopant, by the degree of doping, and by blending with other polymers. In addition, polymeric materials are lightweight, easily processed, and flexible.

Mobile ions within a conducting polymer can reduce the insulation properties of the polymer insulation. Conducting polymers with delocalized electron structure and without mobile ions can be used. Conducting polymers that may be used include but are not limited to polyacetylene, polyaniline, polyfuran, polyfluorene, polythiophene, poly(3-alkyl thiopene), polypyrrole, polyarylene, polyethylenedioxythiophene, polyphenylene, poly(bisthiophenephenylene), poly(3-hexylthiophene), polyheptadiyne, polyheteroaromatic vinylenes, polyisothianaphthene, polymethylpyrrole, polynapthalene, polyparaphenylene, polyparaphenylene sulfide, ladder-type polyparaphenylene, polyarylene vinylene, polyarylene ethynylene, polyphenylene vinylene, alkyl-substituted polypara-phenylene vinylene, poly (2,5 dialkoxyl) paraphenylene vinylene, polyoxyphenylene, polyparaphenylene vinylene, polyphenylene sulfide, polyphenylenevinylene, polythienylene vinylene, various derivatives of these polymers, organometallic derivatives of these polymers, inorganic derivatives of these polymers or block copolymers. Other conducting polymers that may be used are described in Handbook of Conducting Polymers, by Tede A. Skotheim, Ronald L. Elsenbaumer, John R. Reynolds, Marcel Dekker; 2nd Rev&Ex edition (Nov. 1, 1997). Soluble conducting polymers can also be used in the present invention. In addition, soluble conducting polymers, which are easy to disperse, as described in Gorman et al. (J. Am. Chem. Soc., 1993, 115:1397-1409) can also be used.

Additional examples include, but are not limited to, polymer binders such as poly(styrenes), poly(vinyl chloride), poly (vinyl 3-bromobenzoate), poly(methyl methacrylate), poly (n-propyl methacrylate), poly(isobutyl methacrylate), poly (1-hexyl methacrylate), poly(benzyl methacrylate), bisphenol-A polycarbonate, bisphenol-Z polycarbonate, polyacrylate, poly(vinyl butyral), polysulfone, polyphosphazine, polysiloxane, polyamide nylon, polyurethane, sol gel silsesquioxane, and phenoxy resin.

Conducting polymers of high molecular weight typically have a $M_n$ of at least 2,000, preferably at least 10,000, and more preferably at least 20,000. Typically, the $M_n$, of the oligomers and polymers does not exceed 750,000, preferably the $M_n$ does not exceed 500,000 and more preferably the $M_n$, does not exceed 250,000.

The synthesis of conducting polymers is well known and has been described. For instance, polymerization of thiophene monomers has been described in, for example, U.S. Pat. No. 5,300,575 and polymerization of aniline monomers has been described in, for example, U.S. Pat. No. 5,798,170.

The conductive polymer can be made by oxidative polymerization of the monomer or monomers to form the conductive polymer, in the presence of a soluble acid. The acid can be a polymeric or non-polymeric acid. The polymerization is generally carried out in a homogeneous solution, preferably in a homogeneous aqueous solution. The polymerization for obtaining the electrically conducting polymer is carried out in an emulsion of water and an organic solvent. In general, some water is present in order to obtain adequate solubility of the oxidizing agent and/or catalyst. Oxidizing agents such as ammonium persulfate, sodium persulfate, potassium persulfate, and the like, can be used. A catalyst, such as ferric chloride, or ferric sulfate may also be present. The resulting polymerized product will be a solution, dispersion, or emulsion of the doped conductive polymer.

Certain conducting polymers are available from commercial sources. Aqueous dispersions of polypyrrole and a non-polymeric organic acid anion can be obtained from Sigma-Aldrich (St. Louis, Mo.). Aqueous dispersions of poly(2,3-ethylendioxythiophene) can be obtained from H.C. Starck, GmbH. (Leverkusen, Germany). Aqueous and non-aqueous dispersions of doped polyaniline, and doped polyaniline solids can be obtained from Covion Organic Semiconductors GmbH (Frankfurt, Germany) or Ormecon (Ambersbek, Germany).

Carbon black, which is a high molecular weight material with delocalized electron structure, also can be used in the present invention. Planar, graphitic carbon black particles may used in the present invention. Individual carbon black graphitic particles, which do not overlap and are electrically isolate, act as delocalized electron sinks for energetic electrons, which are involved in treeing.

Carbon blacks have chemisorbed oxygen complexes (i.e., carboxylic, quinonic, lactonic, phenolic groups and others) on their surfaces to varying degrees depending on the conditions of manufacture. Any carbon black can be used in the invention including but not limited to carbon blacks with surface areas (nitrogen surface area, NSA, ASTM D6556) of 200 to 1000 $m^2/g$. Carbon Black Feedstock, which is available from The Dow Chemical Company, can be used to produce carbon black. Carbon blacks are commercially available and can be obtained from sources such as Columbian Chemical Company, Atlanta, Ga.

Electron Affinity and Ionization Properties

In some embodiments, a voltage stabilizer of the invention can have an electron affinity of at least 0.0 eV, preferably an electron affinity of at least 5 eV, and more preferably an electron affinity of at least 10 eV.

In another embodiment, a voltage stabilizer of the invention can have an ionization energy that does not exceed 8 eV, preferably the ionization energy does not exceed 5 eV, and more preferably the ionization energy does not exceed 3 eV.

In yet another embodiment, a voltage stabilizer of the invention can have an electron affinity of at least 0.0 eV, preferably an electron affinity of at least 5 eV, and more preferably an electron affinity of at least 10 eV and an ionization energy that does not exceed 8 eV, preferably the ionization energy does not exceed 5 eV, and more preferably the ionization energy does not exceed 3 eV.

Polyolefins:

The polyolefins used in the practice of this invention can be produced using conventional polyolefin polymerization technology, e.g., Ziegler-Natta, metallocene or constrained geometry catalysis. Preferably, the polyolefin is made using a mono- or bis-cyclopentadienyl, indenyl, or fluorenyl transition metal (preferably Group 4) catalysts or constrained geometry catalysts (CGC) in combination with an activator, in a solution, slurry, or gas phase polymerization process. The catalyst is preferably mono-cyclopentadienyl, mono-indenyl or mono-fluorenyl CGC. The solution process is preferred. U.S. Pat. No. 5,064,802, WO93/19104 and WO95/00526 disclose constrained geometry metal complexes and methods for their preparation. Variously substituted indenyl containing metal complexes are taught in WO95/14024 and WO98/49212.

In general, polymerization can be accomplished at conditions well known in the art for Ziegler-Natta or Kaminsky-Sinn type polymerization reactions, that is, at temperatures from 0-250 C, preferably 30-200 C, and pressures from atmospheric to 10,000 atmospheres (1013 megaPascal (MPa)). Suspension, solution, slurry, gas phase, solid state powder polymerization or other process conditions may be employed if desired. The catalyst can be supported or unsupported, and the composition of the support can vary widely. Silica, alumina or a polymer (especially poly(tetrafluoroethylene) or a polyolefin) are representative supports, and desirably a support is employed when the catalyst is used in a gas phase polymerization process. The support is preferably employed in an amount sufficient to provide a weight ratio of catalyst (based on metal) to support within a range of from 1:100,000 to 1:10, more preferably from 1:50,000 to 1:20, and most preferably from 1:10,000 to 1:30. In most polymerization reactions, the molar ratio of catalyst to polymerizable compounds employed is from $10^{-12}$:1 to $10^{-1}$:1, more preferably from $10^{-9}$:1 to $10^{-5}$:1.

Inert liquids serve as suitable solvents for polymerization. Examples include straight and branched-chain hydrocarbons such as isobutane, butane, pentane, hexane, heptane, octane, and mixtures thereof; cyclic and alicyclic hydrocarbons such as cyclohexane, cycloheptane, methylcyclohexane, methylcycloheptane, and mixtures thereof; perfluorinated hydrocarbons such as perfluorinated $C_{4-10}$ alkanes; and aromatic and alkyl-substituted aromatic compounds such as benzene, toluene, xylene, and ethylbenzene.

Polyolefins for medium (3 to 60 kv) and high voltage (>60 kv) insulation are made at high pressure in reactors that are often tubular or autoclave in physical design. The polyolefin polymer can comprise at least one resin or its blends having melt index ($M_1$, $I_2$) from 0.1 to about 50 grams per 10 minutes (g/10 min) and a density between 0.85 and 0.95 grams per cubic centimeter (g/cc). Typical polyolefins include high pressure low density polyethylene, high density polyethylene, linear low density polyethylene metallocene linear low density polyethylene, and constrained geometer catalyst (CGC) ethylene polymers. Density is measured by the procedure of ASTM D-792 and melt index is measured by ASTM D-1238 (190 C/2.16 kg).

In another embodiment, the polyolefin polymer includes but is not limited to copolymers of ethylene and unsaturated esters with an ester content of at least about 5 wt % based on the weight of the copolymer. The ester content is often as high as 80 wt %, and, at these levels, the primary monomer is the ester.

In still another embodiment, the range of ester content is 10 to about 40 wt %. The percent by weight is based on the total weight of the copolymer. Examples of the unsaturated esters are vinyl esters and acrylic and methacrylic acid esters. The ethylene/unsaturated ester copolymers usually are made by conventional high pressure processes. The copolymers can have a density in the range of about 0.900 to 0.990 g/cc. In yet another embodiment, the copolymers have a density in the range of 0.920 to 0.950 g/cc. The copolymers can also have a melt index in the range of about 1 to about 100 g/10 min. In still another embodiment, the copolymers can have a melt index in the range of about 5 to about 50 g/10 min.

The ester can have 4 to about 20 carbon atoms, preferably 4 to about 7 carbon atoms. Examples of vinyl esters are: vinyl acetate; vinyl butyrate; vinyl pivalate; vinyl neononanoate; vinyl neodecanoate; and vinyl 2-ethylhexanoate. Examples of acrylic and methacrylic acid esters are: methyl acrylate; ethyl acrylate; t-butyl acrylate; n-butyl acrylate; isopropyl acrylate; hexyl acrylate; decyl acrylate; lauryl acrylate; 2-ethylhexyl acrylate; lauryl methacrylate; myristyl methacrylate; palmityl methacrylate; stearyl methacrylate; 3-methacryloxy-propyltrimethoxysilane; 3-methacryloxypropyltriethoxysilane; cyclohexyl methacrylate; n-hexylmethacrylate; isodecyl methacrylate; 2-methoxyethyl methacrylate: tetrahydrofurfuryl methacrylate; octyl methacrylate; 2-phenoxyethyl methacrylate; isobornyl methacrylate; isooctylmethacrylate; isooctyl methacrylate; and oleyl methacrylate. Methyl acrylate, ethyl acrylate, and n- or t-butyl acrylate are preferred. In the case of alkyl acrylates and methacrylates, the alkyl group can have 1 to about 8 carbon atoms, and preferably has 1 to 4 carbon atoms. The alkyl group can be substituted with an oxyalkyltrialkoxysilane.

Other examples of polyolefin polymers are: polypropylene; polypropylene copolymers; polybutene; polybutene copolymers; highly short chain branched α-olefin copolymers with ethylene co-monomer less than about 50 mole percent but greater than 0 mole percent; polyiosprene; polybutadiene; EPR (ethylene copolymerized with propylene); EPDM (ethylene copolymerized with propylene and a diene such as hexadiene, dicyclopentadiene, or ethylidene norbornene); copolymers of ethylene and an α-olefin having 3 to 20 carbon atoms such as ethylene/octene copolymers; terpolymers of ethylene, α-olefin, and a diene (preferably non-conjugated); terpolymers of ethylene, α-olefin, and an unsaturated ester; copolymers of ethylene and vinyl-tri-alkyloxy silane; terpolymers of ethylene, vinyl-tri-alkyloxy silane and an unsaturated ester; or copolymers of ethylene and one or more of acrylonitrile or maleic acid esters.

The polyolefin polymer of the present invention also includes ethylene ethyl acrylate, ethylene vinyl acetate, vinyl ether, ethylene vinyl ether, and methyl vinyl ether. One example of commercially available ethylene vinyl acetate is Elvax® from the DuPont™.

The polyolefin polymer of the present invention includes but is not limited to a polypropylene copolymer comprising at least about 50 mole percent units derived from propylene and the remainder from units from at least one α-olefin having up to about 20, preferably up to 12 and more preferably up to 8, carbon atoms, and a polyethylene copolymer comprising at least 50 mole percent units derived from ethylene and the remainder from units derived from at least one α-olefin having up to about 20, preferably up to 12 and more preferably up to 8, carbon atoms.

The polyolefin copolymers useful in the practice of this invention include ethylene/α-olefin interpolymers having a α-olefin content of between about 15, preferably at least about 20 and even more preferably at least about 25, weight percent (wt %) based on the weight of the interpolymer. These interpolymers typically have an α-olefin content of less than about 50, preferably less than about 45, more preferably less than about 40 and even more preferably less than about 35, wt % based on the weight of the interpolymer. The α-olefin content is measured by $^{13}C$ nuclear magnetic resonance (NMR) spectroscopy using the procedure described in Randall (*Rev. Macromol. Chem. Phys., C*29 (2&3)). Generally, the greater the α-olefin content of the interpolymer, the lower the density and the more amorphous the interpolymer, and this translates into desirable physical and chemical properties for the protective insulation layer.

The α-olefin is preferably a $C_{3-20}$ linear, branched or cyclic α-olefin. Examples of $C_{3-20}$ α-olefins include propene, 1-butene, 4-methyl-1-pentene, 1-hexene, 1-octene, 1-decene, 1-dodecene, 1-tetradecene, 1-hexadecene, and 1-octadecene.

The α-olefins also can contain a cyclic structure such as cyclohexane or cyclopentane, resulting in an α-olefin such as 3-cyclohexyl-1-propene (allyl cyclohexane) and vinyl cyclohexane. Although not α-olefins in the classical sense of the term, for purposes of this invention certain cyclic olefins, such as norbornene and related olefins, particularly 5-ethylidene-2-norbornene, are α-olefins and can be used in place of some or all of the α-olefins described above. Similarly, styrene and its related olefins (for example, α-methylstyrene, etc.) are α-olefins for purposes of this invention. Illustrative polyolefin copolymers include ethylene/propylene, ethylene/butene, ethylene/1-hexene, ethylene/1-octene, ethylene/styrene, and the like. Illustrative terpolymers include ethylene/propylene/1-octene, ethylene/propylene/butene, ethylene/butene/1-octene, ethylene/propylene/diene monomer (EPDM) and ethylene/butene/styrene. The copolymers can be random or blocky.

The polyolefins used in the practice of this invention can be used alone or in combination with one or more other polyolefins, e.g., a blend of two or more polyolefin polymers that differ from one another by monomer composition and content, catalytic method of preparation, etc. If the polyolefin is a blend of two or more polyolefins, then the polyolefin can be blended by any in-reactor or post-reactor process. The in-reactor blending processes are preferred to the post-reactor blending processes, and the processes using multiple reactors connected in series are the preferred in-reactor blending processes. These reactors can be charged with the same catalyst but operated at different conditions, e.g., different reactant concentrations, temperatures, pressures, etc, or operated at the same conditions but charged with different catalysts.

Examples of olefinic interpolymers useful in the practice of this invention include very low density polyethylene (VLDPE) (e.g., FLEXOMER® ethylene/1-hexene polyethylene made by The Dow Chemical Company), homogeneously branched, linear ethylene/α-olefin copolymers (e.g. TAFMER® by Mitsui Petrochemicals Company Limited and EXACTS by Exxon Chemical Company), and homogeneously branched, substantially linear ethylene/α-olefin polymers (e.g., AFFINITY® and ENGAGE® polyethylene available from The Dow Chemical Company). The more preferred polyolefin copolymers are the homogeneously branched linear and substantially linear ethylene copolymers. The substantially linear ethylene copolymers are especially preferred, and are more fully described in U.S. Pat. Nos. 5,272,236, 5,278,272 and 5,986,028.

Exemplary polypropylenes useful in the practice of this invention include the VERSIFY® polymers available from The Dow Chemical Company, and the VISTAMAXX® polymers available from ExxonMobil Chemical Company. A complete discussion of various polypropylene polymers is contained in *Modern Plastics Encyclopedia*/89, mid October 1988 Issue, Volume 65, Number 11, pp. 6-92.

Polymer Composition:

Voltage stabilizers of the present invention can be used in any amount that reduces electrical treeing. Voltage stabilizers can be used in amounts of at least 0.0001, preferably at least 0.001, and more preferably at least 0.01 wt % based on the weight of the composition. The only limit on the maximum amount of voltage stabilizer in the composition is that imposed by economics and practicality (e.g., diminishing returns), but typically a general maximum comprises less than 20, preferably less than 3 and more preferably less than 2 wt % of the composition.

The composition may contain additional additives including but not limited to antioxidants, curing agents, cross linking co-agents, boosters and retardants, processing aids, fillers, coupling agents, ultraviolet absorbers or stabilizers, antistatic agents, nucleating agents, slip agents, plasticizers, lubricants, viscosity control agents, tackifiers, anti-blocking agents, surfactants, extender oils, acid scavengers, and metal deactivators. Additives can be used in amounts ranging from less than about 0.01 to more than about 10 wt % based on the weight of the composition.

Examples of antioxidants are as follows, but are not limited to: hindered phenols such as tetrakis[methylene(3,5-di-tert-butyl-4-hydroxyhydro-cinnamate)]methane; bis[(beta-(3,5-ditert-butyl-4-hydroxybenzyl)-methylcarboxyethyl)]sulphide, 4,4'-thiobis(2-methyl-6-tert-butylphenol), 4,4'-thiobis(2-tert-butyl-5-methylphenol), 2,2'-thiobis(4-methyl-6-tert-butylphenol), and thiodiethylene bis(3,5-di-tert-butyl-4-hydroxy)hydrocinnamate; phosphites and phosphonites such as tris(2,4-di-tert-butylphenyl)phosphite and di-tert-butylphenyl-phosphonite; thio compounds such as dilaurylthiodipropionate, dimyristylthiodipropionate, and distearylthiodipropionate; various siloxanes; polymerized 2,2,4-trimethyl-1,2-dihydroquinoline, n,n'-bis(1,4-dimethylpentyl-p-phenylenediamine), alkylated diphenylamines, 4,4'-bis(alpha,alpha-demthylbenzyl)diphenylamine, diphenyl-p-phenylenediamine, mixed di-aryl-p-phenylenediamines, and other hindered amine antidegradants or stabilizers. Antioxidants can be used in amounts of about 0.1 to about 5 wt % based on the weight of the composition.

Examples of curing agents are as follows: dicumyl peroxide; bis(alpha-t-butyl peroxyisopropyl)benzene; isopropylcumyl t-butyl peroxide; t-butylcumylperoxide; di-t-butyl peroxide; 2,5-bis(t-butylperoxy)2,5-dimethylhexane; 2,5-bis(t-butylperoxy)2,5-dimethylhexyne-3; 1,1-bis(t-butylperoxy)3,3,5-trimethylcyclohexane; isopropylcumyl cumylperoxide; di(isopropylcumyl) peroxide; or mixtures thereof. Peroxide curing agents can be used in amounts of about 0.1 to 5 wt % based on the weight of the composition. Various other known curing co-agents, boosters, and retarders, can be used, such as triallyl isocyanurate; ethoxylated bisphenol A dimethacrylate; α-methyl styrene dimer; and other co-agents described in U.S. Pat. Nos. 5,346,961 and 4,018,852.

Examples of processing aids include but are not limited to metal salts of carboxylic acids such as zinc stearate or calcium stearate; fatty acids such as stearic acid, oleic acid, or erucic acid; fatty amides such as stearamide, oleamide, erucamide, or n,n'-ethylenebisstearamide; polyethylene wax; oxidized polyethylene wax; polymers of ethylene oxide; copolymers of ethylene oxide and propylene oxide; vegetable waxes; petroleum waxes; non ionic surfactants; and polysiloxanes. Processing aids can be used in amounts of about 0.05 to about 5 wt % based on the weight of the composition.

Examples of fillers include but are not limited to clays, precipitated silica and silicates, fumed silica calcium carbonate, ground minerals, and carbon blacks with arithmetic mean particle sizes larger than 15 nanometers. Fillers can be used in amounts ranging from less than about 0.01 to more than about 50 wt % based on the weight of the composition.

Compounding of a cable insulation material can be effected by standard means known to those skilled in the art. Examples of compounding equipment are internal batch mixers, such as a Banbury™ or Bolling™ internal mixer. Alternatively, continuous single, or twin screw, mixers can be used, such as Farrel™ continuous mixer, a Werner and Pfleiderer™ twin screw mixer, or a Buss™ kneading continuous extruder. The type of mixer utilized, and the operating conditions of the mixer, will affect properties of a semiconducting material such as viscosity, volume resistivity, and extruded surface smoothness.

A cable containing an insulation layer comprising a composition of a polyolefin polymer and an oligomer or conducting polymer with delocalized electron structure can be prepared with various types of extruders, e.g., single or twin screw types. A description of a conventional extruder can be found in U.S. Pat. No. 4,857,600. An example of co-extrusion and an extruder therefore can be found in U.S. Pat. No. 5,575,965. A typical extruder has a hopper at its upstream end and a die at its downstream end. The hopper feeds into a barrel, which contains a screw. At the downstream end, between the end of the screw and the die, there is a screen pack and a breaker plate. The screw portion of the extruder is considered to be divided up into three sections, the feed section, the compression section, and the metering section, and two zones, the back heat zone and the front heat zone, the sections and zones running from upstream to downstream. In the alternative, there can be multiple heating zones (more than two) along the axis running from upstream to downstream. If it has more than one barrel, the barrels are connected in series. The length to diameter ratio of each barrel is in the range of about 15:1 to about 30:1. In wire coating where the polymeric insulation is crosslinked after extrusion, the cable often passes immediately into a heated vulcanization zone downstream of the extrusion die. The heated cure zone can be maintained at a temperature in the range of about 200 to about 35 C., preferably in the range of about 170 to about 25 C. The heated zone can be heated by pressurized steam, or inductively heated pressurized nitrogen gas.

The following examples illustrate various embodiments of this invention. All parts and percentages are by weight unless otherwise indicated.

SPECIFIC EMBODIMENTS

EXAMPLE 1

The ability of a voltage stabilizer, in this example, β-carotene, to reduce electrical treeing is tested. However, as discussed above, any voltage stabilizer can be used. A low density polyethylene, DXM-446, is used to measure electrical treeing with the Double Needle Characteristic Voltage Test (DNCV) as described in ASTM D-3756. Typical voltages for polyethylene range from 9 kv (thermoplastic) to 18 kv (crosslinked).

Double needle samples are prepared as outlined in ASTM D-3756. In brief, DXM-446 is added to a pre-heated 140C Brabender Plasticorder. After the polymer is melted, four samples are prepared: (1) DXM-446; (2) DXM-446+5% Phenanthrene; (3) DXM-446+5% anthracene; and (4) DXM-446+2% β-carotene in mineral oil. The phenanthrene or anthracene are added either as a solid or pre-dissolved in an appropriate solution, such as mineral oil. The samples are removed quickly from the Brabender, and the samples are pressed into plaques of appropriate thickness as described in ASTM-D-3756.

The plaques are cut into rectangular solids as described in ASTM D-3756. Testing needles are inserted into the samples as described in ASTM D-3756. Once the needle is inserted, the samples are placed in a testing apparatus as described in ASTM D-3756. Voltages are applied and samples are tested as described in ASTM D-3756. Additives are considered tree retardant if the sample with the additive has a greater DNCV value than the sample with DXM-446 base polymer alone.

TABLE 1

Results from DNCV Test

| Polymer | Additive | DNCV (kv) |
|---|---|---|
| DXM-446 | None | 9 |
| DXM-446 | 5% Phenanthrene | 10* |
| DXM-446 | 5% Anthracene | 22.4* |
| DXM-446 | 2% β-carotene in mineral oil | >9** |

*Literature
**Expected, not measured

EXAMPLE 2

One useful parameter for describing resistance to electrical tree initiation is "Molar Voltage Difference" (MVD). Additives, such as voltage stabilizers, often are added to an insulator on a weight basis, thus, a molar based parameter can more generally describe the efficiency of the additive. For polymeric additives, a "Segmental Voltage Difference" (SVD) can be useful. The "segment" of the polymer can be defined as the monomeric repeat unit of the polymer. For copolymers, an "average" segmental repeat unit can be calculated from the 'average' weight of the comonomers.

MVD can be defined as follows:

[DNCV(polymer+additive)−DNCV(pure polymer)]/M
(moles additive/Kg polymer)

Double needle samples are prepared as outlined in ASTM D-3756 and as described briefly in Example 1. FIG. 1 is a contour plot of dependence of MVD on adiabatic electron affinity and ionization potential. The additives and the quantum mechanical properties of the additives are listed in Table 2.

Adiabatic electron affinity was chosen over vertical affinity because adiabatic is a molecular property with a physical meaning. Upon formation of the radical anion in a physical system, the anion will adopt geometrically optimal structure that is used to calculate the adiabatic electron affinity.

As shown in FIG. 1, and as measured by MVD, better voltage stabilization performance is achieved from the additives with a higher adiabatic electron affinity and a lower ionization potential. MVD increases with higher electron affinity and lower ionization potential. Additives with these properties can accept electrons due to the high electron affinity, and at the same time, can form ions due to the low ionization potential. Voltage stabilizers with a high electron affinity and a low ionization potential are expected to inhibit and impede electrical tree initiation.

Furthermore, a contour plot, such as shown in FIG. 1, can be used to design experiments to identify potentially good voltage stabilizers based on their calculated electron affinities and ionization potentials, and tested for electrical treeing retardation. In addition, the contour plot can be used to determine a preferred concentration of voltage stabilizer.

TABLE 2

Quantum mechanical properties of polycyclic aromatic hydrocarbons used as voltage stabilizers

| Additive | vEA [eV] | aEA [eV] | IP [eV] |
|---|---|---|---|
| o-Terphenyl | −0.30* | 0* | 8.25* |
| Naphthalene | −0.38* | −0.26* | 7.98* |
| Phenanthrene | −0.21* | −0.05* | 7.86* |
| Chrysene | 0.19* | 0.29* | 7.54* |

TABLE 2-continued

Quantum mechanical properties of polycyclic aromatic hydrocarbons used as voltage stabilizers

| Additive | vEA [eV] | aEA [eV] | IP [eV] |
|---|---|---|---|
| Fluoranthene | 0.6* | 0.72* | 7.87* |
| Acenaphtylene | −0.5* | −0.39* | 7.64* |
| Pyrene | 0.31* | 0.41* | 7.22* |
| Anthracene | 0.43* | 0.53* | 7.16* |

*Literature

Although the invention has been described in considerable detail by the preceding specification, this detail is for the purpose of illustration and is not to be construed as a limitation upon the following appended claims. All cited reports, references, U.S. patents, allowed U.S. patent applications and U.S. patent application Publications are incorporated herein by reference.

What is claimed is:

1. A power cable comprising an insulation layer in which the insulation layer comprises a polyolefin polymer and an amount of a voltage stabilizer with delocalized electron structure effective to inhibit electrical treeing within the insulation layer wherein the layer functions as an insulating layer, and the voltage stabilizer is selected from the group consisting of a conducting polymer, a carotenoid, carotenoid analog and a carotenoid derivative, wherein when the voltage stabilizer is a conducting polymer, the conducting polymer is present in an amount ranging from 0.0001 to less than 3 weight percent based on the entire weight of the insulation layer.

2. The power cable of claim 1 in which the voltage stabilizer is an oligomer or a polymer of high molecular weight.

3. The power cable of claim 1 in which the carotenoid is selected from the group consisting of: α-carotene, β-carotene, lutein, luteoxanthin, lycopene, zeaxanthin, and fucoxanthin.

4. The power cable of claim 1 in which the conducting polymer is selected from the group consisting of: polyacetylene, polyaniline, polyfuran, polyfluorene, polythiophene, polypyrrole, poly(3-alkyl)thiophene, polyisothianapthelene, polyethylene dioxythiophene, polyparaphenylene vinylene, poly(2,5-dialkoxy)paraphenylenevinylene, polyparaphenylene, polyheptadiyne, poly(3-hexyl)thiophene, and mixtures thereof.

5. The power cable of claim 1 in which the polyolefin polymer is a polypropylene homopolymer or a polyethylene homopolymer.

6. The power cable of claim 1 in which the polyolefin polymer is a polypropylene copolymer comprising at least about 50 mole percent units derived from propylene and the remainder from units derived from at least one α-olefin comprising up to about 20 carbon atoms.

7. The power cable of claim 1 in which the polyolefin polymer is a polyethylene copolymer comprising at least about 50 mole percent units derived from ethylene and the remainder from units derived from at least one α-olefin having up to 20 carbon atoms.

8. The power cable of claim 1, wherein the voltage stabilizer when selected from the group consisting of a carotenoid, carotenoid analog and a carotenoid derivative, is present in an amount ranging from 0.0001 to 20wt% based on the entire weight of the insulation layer.

9. The power cable of claim 1, wherein the voltage stabilizer when selected from the group consisting of a carotenoid, carotenoid analog and a carotenoid derivative, is present in an amount ranging from 0.0001 to <3 wt% based on the entire weight of the insulation layer.

10. The power cable of claim 1, wherein the insulation layer comprises 0.0001 to <2 wt% of the voltage stabilizer.

11. An insulation composition comprising a polyolefin polymer and a voltage stabilizer with delocalized electron structure in an amount effective to inhibit electrical treeing within the insulation composition, wherein the voltage stabilizer is selected from the group consisting of a conducting polymer, a carotenoid, carotenoid analog and a carotenoid derivative, wherein when the voltage stabilizer is a conducting polymer, the conducting polymer is present in an amount ranging from 0.0001 to less than 3 weight percent based on the entire weight of the composition.

12. The composition of claim 11 in which the carotenoid is selected from the group consisting of: α-carotene, β-carotene, lutein, luteoxanthin, lycopene, zeaxanthin, and fucoxanthin.

13. The composition of claim 11 in which the conducting polymer is selected from the group consisting of: polyacetylene, polyaniline, polyfuran, polyfluorene, polythiophene, polypyrrole, poly(3-alkyl)thiophene, polyisothianapthelene, polyethylene dioxythiophene, polyparaphenylene vinylene, poly(2,5-dialkoxy)paraphenylenevinylene, polyparaphenylene, polyheptadiyne, poly(3-hexyl)thiophene, and mixtures thereof.

14. The composition of claim 11 in which the polyolefin polymer is a polypropylene homopolymer or a polyethylene homopolymer.

15. The composition of claim 11 in which the polyolefin polymer is a polypropylene copolymer comprising at least about 50 mole percent units derived from propylene and the remainder from units derived from at least one α-olefin comprising up to about 20 carbon atoms.

16. The composition of claim 11 in which the polyolefin polymer is a polyethylene copolymer comprising at least about 50 mole percent units derived from ethylene and the remainder from units derived from at least one α-olefin having up to 20 carbon atoms.

17. A method of reducing electrical treeing in a power cable, the cable comprising a polyolefin insulation layer, the method comprising including in the insulation layer a voltage stabilizer with delocalized electron structure in an amount effective to inhibit electrical treeing within the insulation layer wherein the layer functions as an insulating layer, and the voltage stabilizer is selected from the group consisting of a conducting polymer, a carotenoid, carotenoid analog and a carotenoid derivative, wherein when the voltage stabilizer is a conducting polymer, the conducting polymer is present in an amount ranging from 0.0001 to less than 3 weight percent based on the entire weight of the insulation layer.

* * * * *